United States Patent [19]

MacCracken

[11] Patent Number: 5,054,298

[45] Date of Patent: Oct. 8, 1991

[54] ICE-CAP PREVENTION BARRIER FOR AN ICE BANK

[75] Inventor: Mark M. MacCracken, Englewood, N.J.

[73] Assignee: Calmac Manufacturing Corporation, Englewood, N.J.

[21] Appl. No.: 604,067

[22] Filed: Oct. 26, 1990

[51] Int. Cl.[5] ..... F25D 3/02

[52] U.S. Cl. ..... 62/434; 62/59; 165/10

[58] Field of Search ..... 62/59, 430, 434; 165/10

[56] References Cited

U.S. PATENT DOCUMENTS

| | | | |
|---|---|---|---|
| 2,246,999 | 6/1941 | Morrison | 62/434 X |
| 3,807,194 | 4/1974 | Bond | 62/430 X |
| 4,096,709 | 6/1978 | Barthel | 62/59 X |
| 4,294,078 | 10/1981 | MacCracken | 62/59 |
| 4,831,830 | 5/1989 | Swenson | 62/59 |
| 4,916,910 | 4/1990 | Schroeder | 62/434 X |
| 4,932,222 | 6/1990 | Adams, Jr. | 62/434 X |
| 4,934,150 | 6/1990 | Fessler | 62/59 |
| 4,954,278 | 6/1987 | MacCracken | 165/10 |

*Primary Examiner*—William E. Tapolcai

*Attorney, Agent, or Firm*—Charles J. Brown

[57] ABSTRACT

A thermally insulated ice-cap prevention barrier in an ice bank, extending across the container thereof above a brine-conducting tube bundle immersed in a phase-change material, to prevent freezing of the phase-change material in an expansion space above the barrier and below a cover on the container.

8 Claims, 2 Drawing Sheets

ICE-CAP PREVENTION BARRIER FOR AN ICE BANK

BACKGROUND OF THE INVENTION

Ice banks are coolness storage devices wherein a phase-change material (PCM) is alternately frozen and thawed by brine circulated through tubes immersed in the PCM. In air conditioning systems and other cooling-cycle apparatus a substantial energy savings can be achieved by chilling the brine to freeze the PCM over time during off-peak load conditons and withdrawing the stored coolness for use during peak-load conditions. See for example U.S. Pat. Nos. 4,671,347 and 4,954,278.

Typically an ice bank is a covered cylindrical container in which an expansion space is provided above the brine tubes immersed in the PCM. A liquid PCM expands as it freezes and if it is water, as is most frequently the case, it will undergo an expansion of 9% since liquid water occupies only 91% of its volume when frozen. As the PCM freezes around the brine tubes its upper liquid level therefore rises and must occupy the expansion space.

If the frozen PCM around the tubes is sub-cooled well below its freezing temperatures for a prolonged period the liquid PCM in the expansion space above it will also freeze. This presents a problem later when coolness is being withdrawn from the ice bank, as in peak-load conditions. The relatively warm brine to be cooled by circulation through the tubes will eventually thaw all of the PCM around the tubes, whereas in the expansion space above where there are no brine tubes the frozen PCM will remain as ice long after the PCM around the brine tubes below is fully thawed. This leaves what is called an ice-cap in the expansion space which is quite difficult to eliminate. An ice-cap depletes the liquid PCM available for maintaining all the brine tubes immersed and thereby causes air to come between the solid PCM and the tubes, which greatly decreases heat transfer. In some cases electric warm air blowers have been untilized to thaw ice-caps but it may take as much as one or two days to accomplish full thawing.

One method of ice-cap prevention is to insure that the chiller is operated to sub-cool the brine in response to the temperature of the brine leaving the ice bank and returning to the chiller. The chiller is run at full load during the freezing cycle until the return brine temperature reduces to approximately 27° F. or 28° F. At that point the chiller is shut down and the brine supply temperature is then at about 22° F. or 21° F. By carefully avoiding excessive sub-cooling of the ice in this fashion an ice-cap will not form in the expansion space under most circumstances. The disadvantage, however, is that close monitoring of the brine return temperature is necessary. If the chiller is not turned off or fails to turn off at a return brine temperature of 28° F. and instead continues to operate until the return brine temperature is about 23° F. it is virtually certain that over a number of cycles an ice-cap will form.

It is the principal purpose of the present invention to provide fail-safe apparatus which can be certain to prevent formation of ice-caps notwithstanding excessive sub-cooling of the frozen PCM (water) even though the frozen PCM may be chilled to as low as 15° F.

SUMMARY OF THE INVENTION

The invention provides ice-cap prevention means for an ice bank wherein a thermally insulated container with a thermally insulated removable cover contains a tube bundle through which brine is conducted to freeze and thaw a phase-change material in which the tube bundle is immersed within the container. The liquid phase-change material initially is at a level below the cover to provide an expansion space above the tube bundle to be filled by liquid phase-change material as freezing thereof progresses around the tube bundle. The ice-cap prevention means comprises a thermally insulated barrier extending substantially completely laterally across the interior of the container above the tube bundle. Spacer means are provided for preventing upward displacement of the barrier toward the cover as the liquid phase-change material rises into the expansion space above the barrier. As a consquence the thermally insulated barrier prevents freezing of the phase-change material rising into the expansion space when the phase-change material below the barrier around the tube bundle is frozen.

In a preferred form of the invention the insulation barrier is of rigid closed-cell extruded plastic foam such a polystyrene. The container may be cylindrical and the thermally insulated barrier is circular. The barrier may comprise two half discs co-joined along their respective straight edges, which edges may be interlocking. Apertures may be formed in the barrier to permit access to the tube bundle of brine supply and return headers. The spacer means for preventing upward displacement of the barrier may be molded ribs depending integrally from the cover to abut the barrier.

DESCRIPTION OF PREFERRED EMBODIMENT

Figure 1:
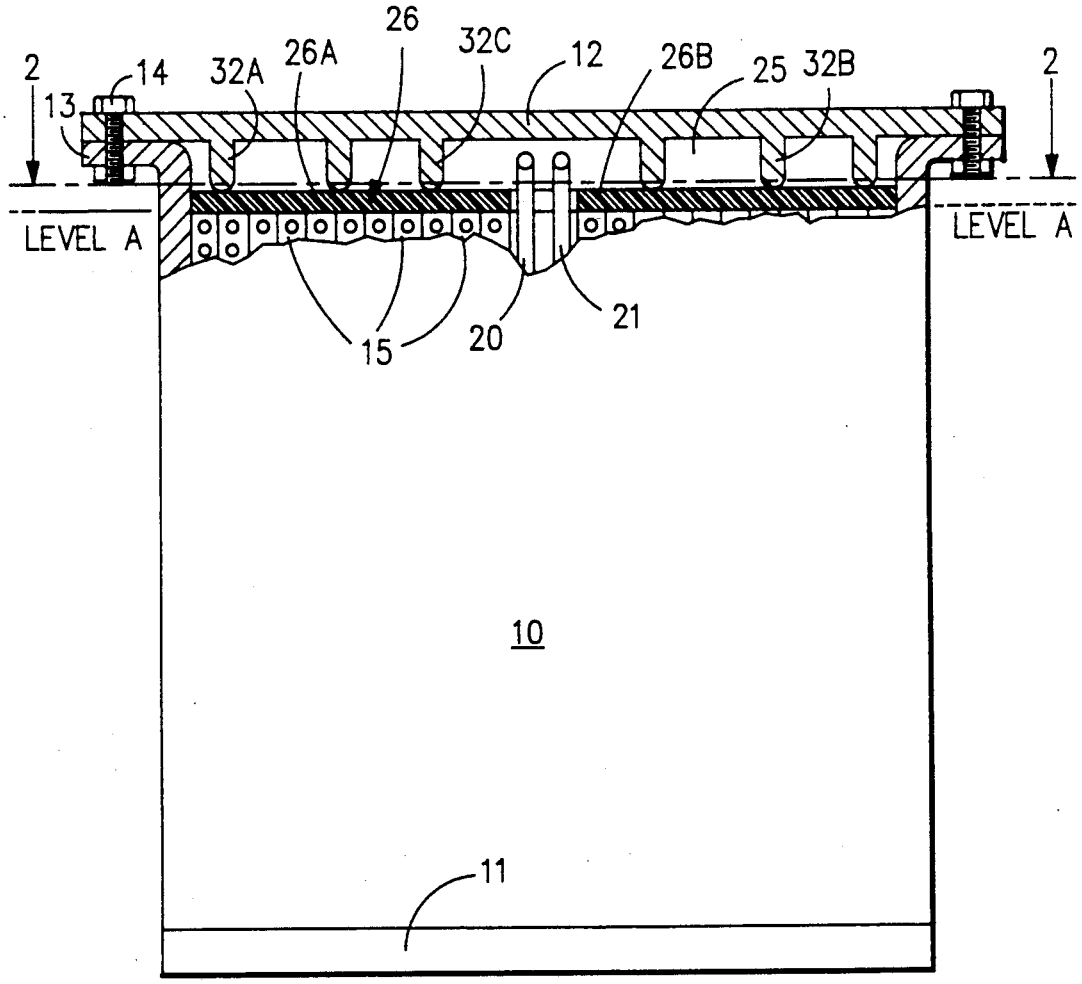
FIG. 1 is an elevation partly in section showing the barrier of the invention in place beneath the cover of the ice bank.

The ice bank shown in the drawings includes a container 10 having a cylindrical wall of composite construction. It may include an outer skin of aluminum foil covering thermal insulation which enclosures a tank member of rigid plastic such as polyethylene. An insulated base 11 defines the bottom of the container 10. The top comprises a molded cover 12 with a foam insulation core. The periphery of the cover 12 may be secured to a flange 13 around the upper edge of the container 10 as by a circle of twenty-three bolts 14. Typically the container 12 may be somewhat more than eight feet high and over seven feet in diameter. Coiled within it are extended lengths of plastic heat exchange tubing, perhaps of $\frac{5}{8}$ inch outside diameter laid in a series of flat spirals with the turns in a given spiral and the spirals themselves held apart by spacer strips 15 as described in U.S. Pat. No. 4,671,340.

Figure 2:
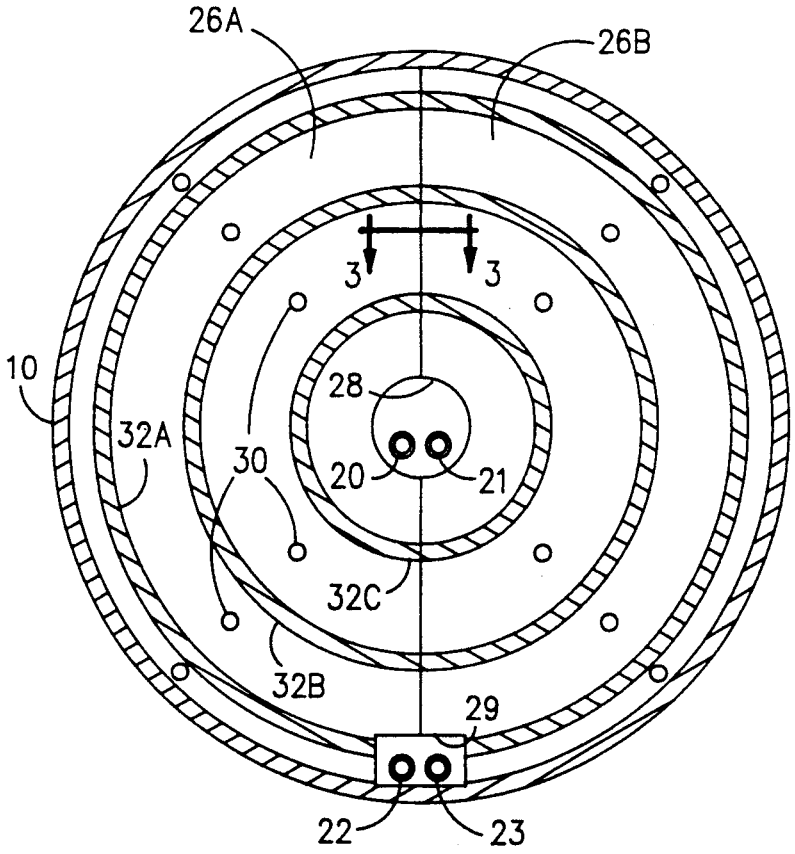
FIG. 2 is a horizontal section taken along the line 2—2 of FIG. 1.

Circulated through the heat exchange tubing held by the spacer strips 15 is a brine such as 25% ethylene glycol. The brine either melts or freezes a PCM which when entirely liquid fills the container to the level indicated in FIG. 1 as Level A, just covering the tops of the spacer strips 15 and all of the heatexchange tubes held thereby. Inlet and outlet headers 20 and 21 extend off-center down the middle of the bundle of tubes and inlet and outlet headers 22 and 23 extend down the outside of the bundle of tubes, as shown in FIG. 2. By providing two pairs of inlet and outlet headers it is possible to circulate brine through the heat exchange tubes in a counter-flow fashion from one level to the next.

An expansion space 25 is defined below the underside of the cover 12 and above initial Level A of the liquid PCM. As noted previously its purpose is to provide space for the liquid PCM to rise as the PCM freezes to ice around the heat exchange tubes during the charging cycle. Since there are no heat exchange tubes in the expansion space 25 the liquid PCM occupying that space could freeze during sub-cooling of the ice below, unless preventive measures are taken as in accordance with this invention.

Figure 3:
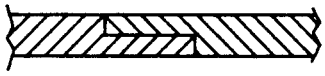
FIG. 3 is an enlarged fragmentary vertical section taken along the line 3—3 of FIG. 2.

The ice-cap preventing means of the invention consists of a thermally insulated barrier 26 extending substantially completely laterally across the interior of the container 10 at the Level A. The barrier 26 is formed of waterproof closed-cell polystyrene extruded rigid foam which may be bonded with impermeable foil on both sides. As shown in FIG. 2 the barrier 26 is formed of two half discs 26A and 26B joined along their respective straight edges. The co-joined edges are interlocked in a butt lap as shown in FIG. 3. They define a central circular aperture 28 through which the inlet and outlet headers 20 and 21 extend. They also define an aperture 29 near their common periphery through which the headers 22 and 23 extend. In addition, to permit easy passage of the liquid PCM through the barrier 26 during alternate freezing and thawing, a suitable array of small drain holes 30 may be formed in each of the half discs 26A and 26B.

The barrier 26 may be approximately one-half inch to one inch thick. By itself, however, it lacks sufficient strength to withstand the rising force of the buoyant ice beneath it when freezing is complete. In one form of the ice bank of the invention 1,620 gallons of water are held within the container 10 and when fully frozen exert an upward buoyancy force of almost 1,600 lbs. To resist this force and to stregthen the barrier 26 a series of ribs 32A, 32B and 32C are provided which depend integrally from and are molded as part of the underside of the cover 12 to abut the top side of the barrier 26 as more clearly shown in FIG. 1. They are shown to be annular and concentric but they could also be radial. The array of holes 30 in the barrier 26 should be positioned to insure that as the liquid PCM rises it can readily fill all parts of the expansion space 25 which, as should be apparent, is somewhat compartmentalized by the ribs 32A, 32B and 32C.

In the operation of the improved ice bank of the invention liquid PCM is added to the container 10 until it reaches Level A. Each of the half discs 26A and 26B are placed on top of the spacers 15 at Level A with their straight edges adjoining and interlocked and thereby fitted around the pairs of inlet and outlet headers 20–21 and 22–23. The cover 12 is then bolted in place on the flange 13 of the container 10 and as this is done the ribs 32A, 32B and 32C come into abutting contact with the top side of the barrier 26.

When it is desired to store coolness in the ice bank, brine is sub-cooled below its freezing temperature, for example to 21° F. for a water PCM which of course freezes at 32° F. This causes ice to form gradually around all of the heat exchange tubes held by the spacer strips 15. As the ice forms it expands and forces the liquid PCM up through the various apertures 28 and 29 and holes 30 in the barrier 26 until virtually all of the expansion space 25 is filled with liquid PCM. When charging is complete the ice beneath the barrier 26 is solid and may be sub-cooled to as low as 15° F. Nonetheless the liquid PCM above the barrier 26 does not freeze because the barrier provides sufficient thermal insulation so that the cold entering through the barrier 26 into the expansion space 25 is more than cancelled by the heat gain through the cover 12 and around the edges thereof into the space 25. Consequently an ice-cap does not form in the space 25.

The scope of the invention is to be taken from the following claims rather than from the specifics of the preferred embodiment described above. Certain variations in that preferred embodiment within the scope of the invention should be apparent. For example, the harrier 26 may be strengthened and held against the buoyant upward force of the ice beneath by spacers other than the ribs 32A, 32B and 32C, for example by separate spacer elements. The barrier 26 may be formed in more that two half discs or even as a single disc through which the inlet and outlet headers are inserted. The particular cross-sectional configuration of the container 10 may be appropriately modified to be of rectangular shape or any shape other than cylindrical. The manner in which the heat exchange tubes are held within the container forms no part of the invention and indeed they may be vertically disposed rather than horizontally in successive spirals.

What is claimed is:

1. In an ice bank wherein a thermally insulated container with a thermally insulated removable cover contains a tube bundle through which brine is conducted to freeze and thaw a phase-change material in which the tube bundle is immersed within the container, the liquid phase-change material initially being at a level below the cover to provide an expansion space above the tube bundle to be filled by liquid phase-change material as freezing thereof progresses around the tube bundle, ice-cap prevention means comprising a) a thermally insulated barrier extending substantially completely laterally across the interior of the container above the tube bundle, and b) spacer means for preventing upward displacement of the barrier toward the cover as the liquid phase-change material rises into the expansion space above the barrier, c) whereby the thermally insulated barrier prevents freezing of the phase-change material rising into the expansion space when the phase-change material below the barrier around the tube bundle is frozen.

2. An ice bank according to claim 1 wherein the insulation barrier is rigid closed-cell extruded plastic foam.

3. An ice bank according to claim 1 wherein the container is cylindrical and the thermally insulated barrier is circular.

4. An ice bank according to claim 3 wherein the barrier comprises two half discs co-joined along their respective straight edges.

5. An ice bank according to claim 4 wherein the co-joined straight edges of the half discs are interlocking.

6. An ice bank according to claim 1 wherein apertures are formed in said barrier to permit access to the tube bundle of brine supply and return headers and to allow passage of the liquid phase-change material to and from the expansion space.

7. An ice bank according to claim 1 wherein the spacer means for preventing upward displacement of the barrier are molded ribs depending integrally from the cover to abut the barrier.

8. An ice bank wherein a thermally insulated cylindrical container with a thermally insulated removable circular cover contains a tube bundle through which brine is conducted to freeze and thaw a phase-change material in which the tube bundle is immersed within the container, the liquid phase-change material initially being at a level below the cover to provide an expansion space above the tube bundle to be filled by liquid phase-changer material as freezing thereof progresses around the tube bundle, ice-cap prevention means comprising a) a thermally insulated circular barrier of rigid closed-cell extruded plastic foam extending substantially completely laterally horizontally across the interior of the container above the tube bundle, b) said barrier comprising two half discs co-joined along their respective interlocked straight edges, c) apertures formed in said barrier to permit access to the tube bundle of brine supply and return headers and to allow passage of the liquid phase-change material to and from the expansion space, and d) spacer means for preventing upward displacement of the barrier toward the cover as the liquid phase-change material rises into the expansion space above the barrier comprising molded ribs depending integrally from the cover to abut the barrier, e) whereby the thermally insulated barrier prevents freezing of the phase-change material rising into the expansion space when the phase-change material below the barrier around the tube bundle is frozen.

* * * * *